US012352108B2

(12) United States Patent
Zhang et al.

(10) Patent No.: US 12,352,108 B2
(45) Date of Patent: Jul. 8, 2025

(54) DEVICES, SYSTEMS, AND METHODS FOR A BIT INCLUDING A MATRIX PORTION AND A STEEL PORTION

(71) Applicant: Schlumberger Technology Corporation, Sugar Land, TX (US)

(72) Inventors: Youhe Zhang, Spring, TX (US); Huimin Song, Spring, TX (US); Mingdong Cai, Cypress, TX (US); Ting Ren, Conroe, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/240,923

(22) Filed: Aug. 31, 2023

(65) Prior Publication Data

US 2024/0068299 A1 Feb. 29, 2024

Related U.S. Application Data

(60) Provisional application No. 63/500,813, filed on May 8, 2023, provisional application No. 63/374,099, filed on Aug. 31, 2022.

(51) Int. Cl.
*E21B 10/62* (2006.01)
*E21B 10/08* (2006.01)

(52) U.S. Cl.
CPC ..... *E21B 10/08* (2013.01); *E21B 10/62* (2013.01)

(58) Field of Classification Search
CPC ..... E21B 10/08; E21B 10/62; E21B 10/602; E21B 10/42
See application file for complete search history.

(56) References Cited

U.S. PATENT DOCUMENTS

| | | | | |
|---|---|---|---|---|
| 11,035,175 | B2 * | 6/2021 | Zhang | B23P 15/24 |
| 2007/0119625 | A1 * | 5/2007 | Brady | E21B 10/26 175/57 |
| 2008/0128134 | A1 * | 6/2008 | Mudunuri | E21B 43/30 166/302 |
| 2008/0135304 | A1 * | 6/2008 | Duggan | E21B 10/00 175/325.2 |
| 2009/0032309 | A1 * | 2/2009 | Schwefe | E21B 17/1092 419/11 |
| 2009/0301787 | A1 * | 12/2009 | Smith | E21B 10/42 29/428 |
| 2010/0108397 | A1 * | 5/2010 | Lyons | E21B 10/42 175/426 |
| 2010/0193255 | A1 * | 8/2010 | Stevens | E21B 10/54 175/425 |
| 2011/0120780 | A1 * | 5/2011 | Vezirian | E21B 12/04 175/85 |
| 2016/0281438 | A1 * | 9/2016 | Olsen | E21B 10/54 |
| 2018/0320449 | A1 * | 11/2018 | Zhang | B23P 15/24 |
| 2024/0068302 | A1 | 2/2024 | Zhang | |

FOREIGN PATENT DOCUMENTS

WO 2024232992 A1 11/2024

* cited by examiner

*Primary Examiner* — Steven A MacDonald
(74) *Attorney, Agent, or Firm* — Jeffrey D. Frantz

(57) ABSTRACT

A bit may include a matrix portion, the matrix portion exposed at a cone region and a nose region of the bit. A bit may include a steel portion, the steel portion including a bit connection, the steel portion exposed at a gauge region of the bit. A bit may include a plurality of cutting elements secured to the matrix portion at the cone region and the nose region.

12 Claims, 10 Drawing Sheets

DEVICES, SYSTEMS, AND METHODS FOR A BIT INCLUDING A MATRIX PORTION AND A STEEL PORTION

CROSS-REFERENCE TO RELATED APPLICATIONS

The present application claims priority to and the benefit of U.S. Provisional Patent Application Ser. No. 63/500,813 titled "DEVICES, SYSTEMS, AND METHODS FOR A BIT HAVING AN INTEGRAL METALLIC CONNECTION" filed May 8, 2023, the disclosure of which is incorporated herein by reference in its entirety. The present application also claims priority to and the benefit of U.S. Provisional Patent Application Ser. No. 63/374,099 titled "DEVICES, SYSTEMS, AND METHODS FOR A REINFORCING RING IN A BIT" filed Aug. 31, 2022, the disclosure of which is incorporated herein by reference in its entirety.

BACKGROUND OF THE DISCLOSURE

Downhole drilling equipment may be used to reach subterranean reservoirs of oil, natural gas, water, and other natural resources. Downhole drilling equipment may drill wellbores that extend up to tens of thousands of feet in length. To advance a wellbore, a bit having a plurality of cutting elements is used. The bit is connected to a drill string and is rotated to degrade the formation and increase the depth of the wellbore.

SUMMARY

In some aspects, the techniques described herein relate to a bit. The bit includes a matrix portion. The matrix portion is exposed at a cone region and a nose region of the bit. The bit includes a steel portion. The steel portion includes a bit connection. The steel portion is exposed at a gauge region or a portion of a gauge region of the bit. A plurality of cutting elements are secured to the matrix portion at the cone region and the nose region.

In some aspects, the techniques described herein relate to a method for manufacturing a bit. The method includes securing a steel portion of the bit inside a mold. The steel portion located at a gauge region of the mold. The steel portion including a bit connection. The method includes flowing matrix material into a cone region and a nose region of the mold. The steel portion is located radially outward of the matrix material in the gauge region of the mold. The method includes infiltrating the matrix material with an infiltrant to form a matrix portion of the bit, wherein infiltrating the matrix material secures the matrix portion to the steel portion.

In some aspects, the techniques described herein relate to a bit. The bit includes a body. The body includes a steel portion and a matrix portion. A plurality of blades extend from the body. At least one blade of the plurality of blades includes a cone region, a nose region, a shoulder region, and a gauge region. The steel portion extends from the body into the plurality of blades at the gauge region. The matrix portion extends from the body into at least one blade of the plurality of blades at the cone region and the nose region and possibly at least partially into the gauge region.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a representation of a bit having a matrix portion and a steel portion, according to at least one embodiment of the present disclosure;

FIG. 2-2 is a cross-sectional view of the bit of FIG. 2-1;

FIG. 2-3 is an exploded view of the bit of FIG. 2-2;

FIG. 3 is a representation of a bit manufacturing system, according to at least one embodiment of the present disclosure;

DETAILED DESCRIPTION

This disclosure generally relates to a bit and devices, systems, and methods relating thereto. The bit has an infiltrated matrix portion and a steel portion. The infiltrated matrix portion may be located at or extend to the cone and nose regions of the blades of the bit. The steel portion may be located at or extend to the gauge region of the blade of the bit. During manufacturing, the steel portion may be inserted into a mold. Granular matrix material may be flowed into the mold around the steel portion. The matrix material may be infiltrated with an infiltrant with the steel portion in the mold, thereby forming the infiltrated matrix portion bonded to the steel portion.

The steel portion of the bit may include a connection portion. The connection portion may be proximate the gauge regions of the blades. In some embodiments, the connection portion may be integrally formed with the gauge regions of the blades. Integrally forming at least a portion of the gauge regions of the blades with the connection portion may reduce the length of the bit by eliminating a welded region between a steel blank embedded in the matrix portion and a connection portion. This may help to decrease the make-up length of the bit. Decreasing the make-up length of the bit may help to increase the achievable dog leg severity (DLS) and/or drilling efficiency of the drilling system.

To maintain the connection portion in accordance with industry standards (such as American Petroleum Institute (API) connection strength standards), the connection portion may be heat-treated to cause the strength and other properties of the connection portion to come into compliance with the relevant industry standards. In this manner, any heat treatment that is impacted or altered during the high-temperature infiltration of the bit may be re-applied and/or the effects of such an impact reduced and/or mitigated.

Figure 1:
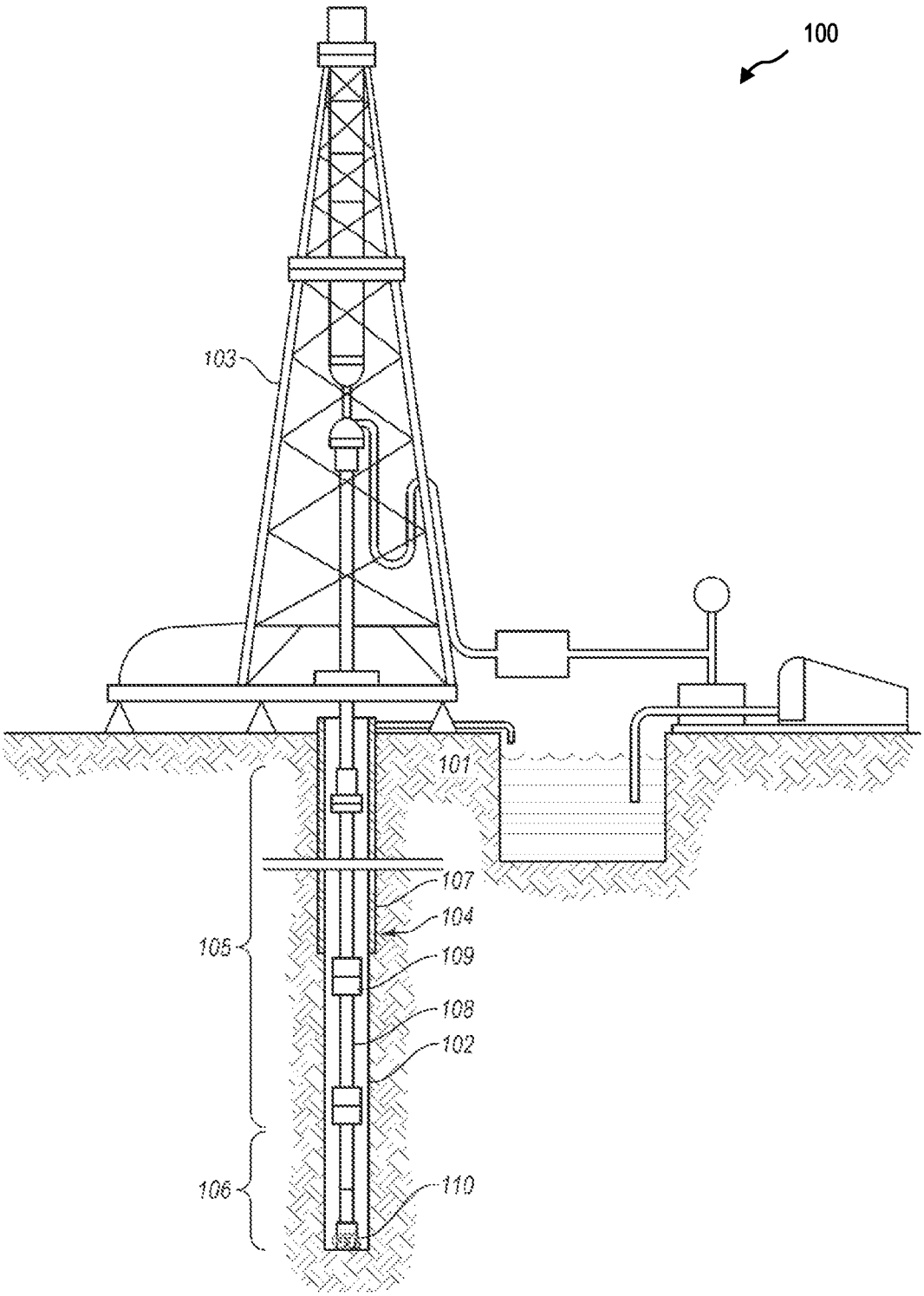
FIG. 1 is a representation of a drilling system for drilling an earth formation to form a wellbore, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as one or more of gravity, magnetic north, and true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

The bit 110 may include a connection to the RSS and/or other portion of the BHA 106. Conventionally, during manufacturing of a bit 110, a steel blank may be inserted into a bit mold and a matrix body may be formed around the steel blank. The steel blank may extend out of the bit body. To connect the bit to the RSS and/or other portion of the BHA 106, the steel blank may be secured to a bit connection. For example, the steel blank may be welded to the bit connection. Welding the steel blank to the connection portion may increase the manufacturing time, expense, and/or complexity of the bit 110. In some situations, welding the steel blank to the connection portion may extend the length of the bit 110. For example, welding the connection portion to the steel blank may include machining grooves or other welding section into the outer periphery of the steel blank and the connection portion. The grooves may be filled in using welding material, and the grooves may increase the contact area of the weld, thereby increasing the strength of the welded connection.

The distance between the uppermost cutter of the bit 110 and the RSS may help to determine the dog leg severity (DLS) of the RSS. For example, a shorter distance between the bit 110 and the RSS may increase the DLS of the RSS. As discussed above, the welded connection between the steel blank and the connection portion may increase the length of the bit, thereby reducing the maximum possible DLS of the RSS.

In accordance with at least one embodiment of the present disclosure, the bit 110 may include a steel portion and a matrix portion. The steel portion may include the bit connection to the RSS and/or the BHA 106. In some embodiments, the steel portion may be integrally formed with the bit connection. During formation of the bit 110, matrix material may be infiltrated while the matrix material is in contact with the steel portion in the mold. This may help to enable formation without a weld between the bit connection and the steel portion of the bit 110. In this manner, the bit 110 may have a shorter length. This may shorten the DLS of the RSS and/or increase the drilling efficiency of the BHA 106.

In some situations, infiltrating the matrix portion while the bit connection is in the mold may alter the heat treatment of the steel portion and the integrally formed bit connection. This may result in a change in compressive strength, tensile strength, ductility, elasticity, brittleness, malleability, hardness, any other material property, and combinations thereof. In some situations, the resulting bit connection may not meet industry standards for connections in tool joints and downhole connections, including industry standards set by the American Petroleum Association (API).

In accordance with at least one embodiment of the present disclosure, the integrally formed bit connection may be heat treated after the matrix portion is infiltrated. Heat treating the integrally formed bit connection may alter the properties of the integrally formed bit connection. In some embodiments, heat treating the integrally formed bit connection may cause the properties of the bit connection to meet or exceed the industry standards for bit connections. In this manner, the resulting bit 110 may have a shortened length while still maintaining a bit connection in compliance with industry standards.

Figures 1, 2:
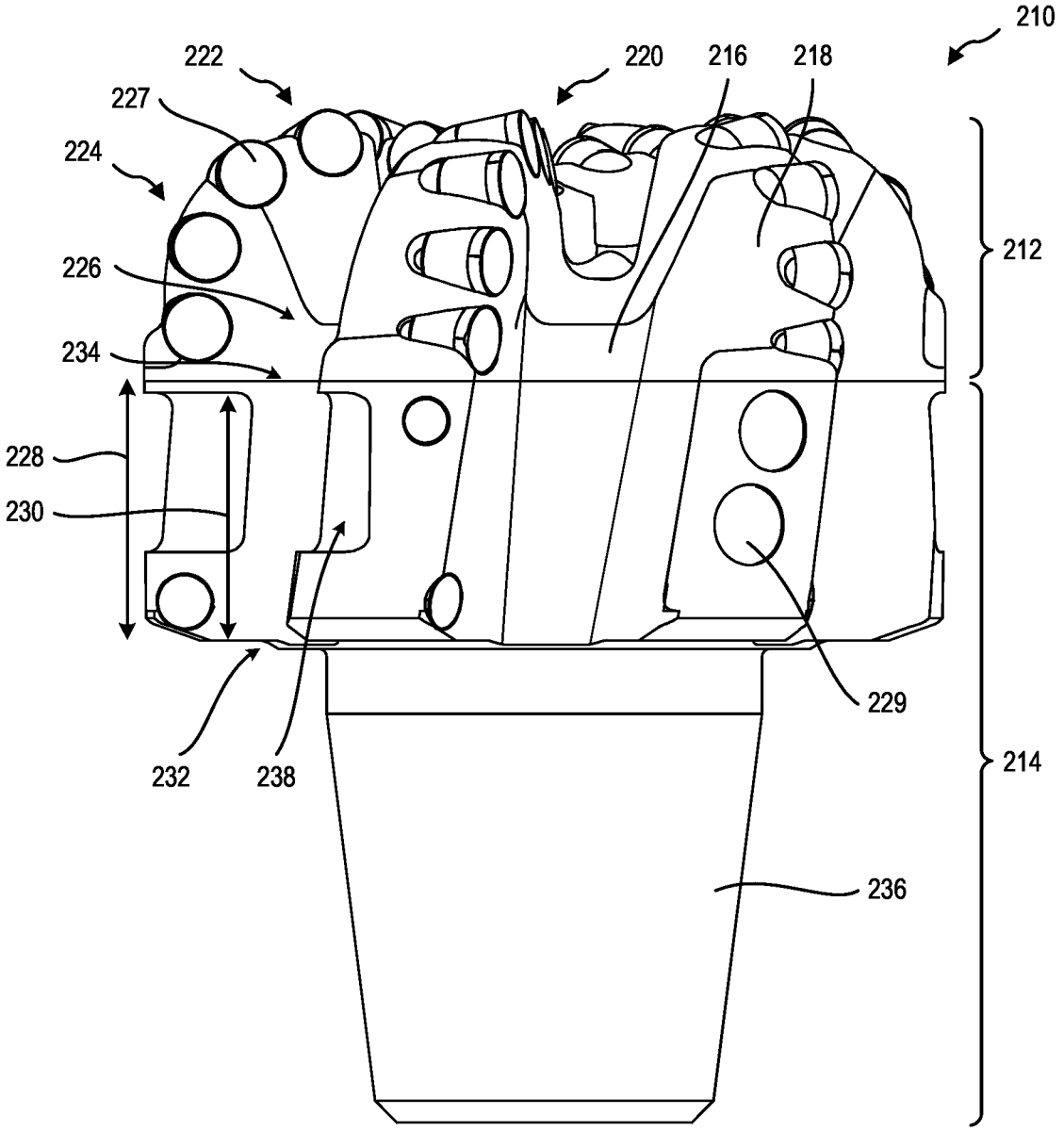
Figure 2:
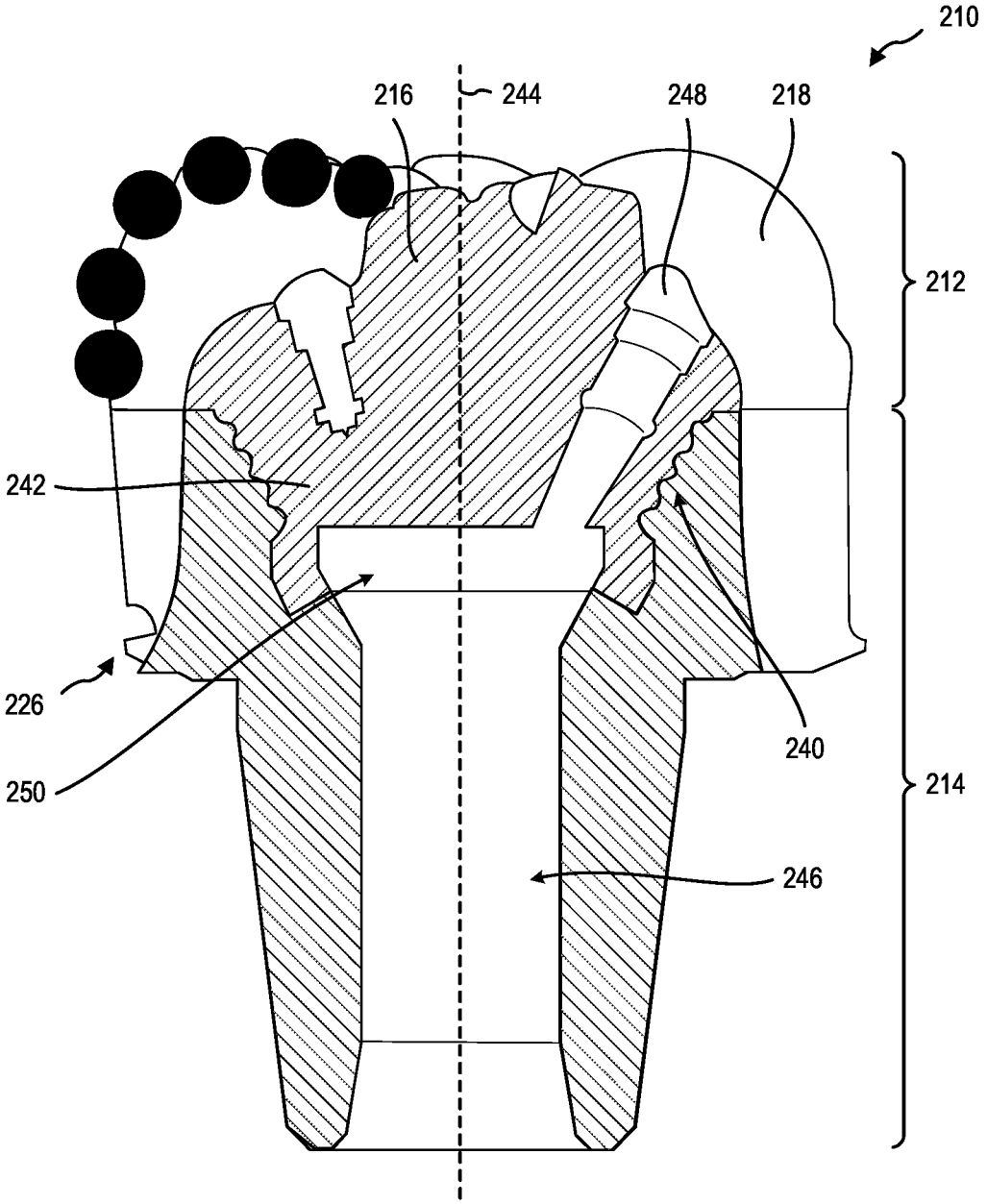

FIG. 2-1 is a representation of a bit 210 having a matrix portion 212 and a steel portion 214, according to at least one embodiment of the present disclosure. The matrix portion 212 may be formed from an infiltrated matrix material. The infiltrated matrix material may include a matrix powder of a superhard material infiltrated with a metallic binder. The matrix powder may include any granular matrix material or powder, including, but not limited to, metallic matrix powder, a ceramic matrix powder, a carbide matrix powder, a refractory material matrix powder, a refractory carbide powder, or any other matrix powder. The infiltrant may be any type of infiltrant, including a copper-based infiltrant, a nickel-based infiltrant, any other infiltrant, and combinations thereof.

The steel portion 214 may be formed from a steel alloy. In some embodiments, the steel portion 214 may be formed from any other metallic alloy. For example, the steel portion 214 may be formed from a cobalt-based alloy, a nickel-based alloy (including UNS N06625, UNS N07718, UNS N08810), a ferrous-based alloy, (including stainless alloys, martensitic grades (17-4PH, 13-8Mo), austenitic grades (17-7PH AM350, 15-7PH), high strength low alloy steels (medium carbon grades including 4140, 8630, 4140, 4145)), any other metallic alloys, and combinations thereof. The list provided are for exemplary demonstration and not exhaustive.

The bit 210 includes a body 216 having a plurality of blades 218 connected thereto and extending from the body 216. The blades 218 define several regions, including a cone region 220, a nose region 222, a shoulder region 224, and a gauge region 226. The crown of the bit 210 may include the cone region 220, the nose region 222, and the shoulder region 224, and the base of the bit 210 may include the gauge region 226.

While the embodiment of FIG. 2-1 illustrates each blade 218 having the cone region 220 and the nose region 222, it should be understood that some bits may include blades that do not extend into one or both of the cone region 220 and the nose region 222. For example, a bit may include a blade (e.g., a secondary blade) that extends from the gauge region 226 and into the shoulder region 224, but not the cone region 220 and the nose region 222. Unless explicitly stated otherwise, the techniques described herein may be applicable to bits including such secondary blades, including steel portions that extend to the gauge region 226 and matrix portions that extend to whatever portion of the secondary blade are present. For example, a secondary blade may extend into the shoulder region 224, and the secondary blade may have the steel portion 214 exposed in at least a portion of the gauge region 226 and the matrix portion 212 exposed in the shoulder region 224. In some examples, a secondary blade may extend into the shoulder region 224, and the secondary blade may have the steel portion 214 exposed in the gauge region 226 and at least a portion of the shoulder region 224, with the matrix portion 212 exposed in at least a portion of the shoulder region 224. In some examples, a secondary blade may extend into the nose region 222, and the secondary blade may have the steel portion 214 exposed in at least a portion of the gauge region 226 and the matrix portion 212 exposed in the shoulder region 224 and the nose region 222. In some examples, a secondary blade may extend into the nose region 222, and the secondary blade may have the steel portion 214 exposed in the gauge region 226 and at least a portion of the shoulder region 224, and the matrix portion 212 exposed in at least a portion of the shoulder region 224 and the nose region 222.

In the embodiment shown, the matrix portion 212 may include at least a portion of the body 216 and the blades 218. In some embodiments, the matrix portion 212 may be exposed at least a portion of the blades 218. As used herein, "exposed" may be interpreted to mean forming an outer surface of a structure. For example, a material may be exposed in the bit 210 if that material forms the outer surface of the bit 210. A material may be exposed in the bit 210 at one or more different structures of the bit 210. For example, a material may be exposed at the body 216, a blade 218, multiple blades 218, a region of a blade 218 (e.g., the cone region 220, the nose region 222, the shoulder region 224, the gauge region 226), any other structure of the bit 210, and combinations thereof. In some examples, a material may be exposed in only a portion of the bit 210. In some embodiments, different structures (or different regions of a single structure) of the bit 210 may have different materials exposed. In some embodiments, a structure of the bit may have multiple materials exposed.

As used herein, when the matrix portion 212 is exposed at a portion or structure of the bit 210, it is to be understood that it is the material that forms the matrix portion 212 that is exposed at the portion or structure of the bit. Further, as used herein, when the steel portion 214 is exposed at a portion or structure of the bit 210, it is to be understood that it is the material that forms the steel portion 214 that is exposed at the portion or structure of the bit 210.

In accordance with at least one embodiment of the present disclosure, the matrix portion 212 may be exposed in at least one of the cone region 220 or the nose region 222 of the bit 210. In the embodiment shown, the matrix portion 212 is exposed in the cone region 220, the nose region 222, and the shoulder region 224 of the bit 210. In some embodiments, the matrix portion 212 may be exposed in the cone region 220, the nose region 222, and/or the shoulder region 224 of the bit 210 at the body 216 and/or the blades 218 of the bit 210. In some embodiments, the matrix portion 212 may be exposed in the cone region 220, the nose region 222, and/or the shoulder region 224 and a portion of the gauge portion of the bit 210 at the body 216 and/or the blades 218 of the bit 210. The matrix portion 212 may have a high erosion resistance. Exposing the matrix portion 212 at these regions may help to reduce the wear and/or erosion of the bit 210 during drilling activities, thereby extending the operating lifetime of the bit 210.

In accordance with at least one embodiment of the present disclosure, the steel portion 214 may be exposed at the gauge region 226 of the bit 210. For example, the steel portion 214 may be exposed at the gauge region 226 of the bit 210 at one or more of the blades 218 of the bit 210. In some examples, the steel portion 214 may be exposed at the gauge region 226 at the body 216 of the bit 210.

In some embodiments, the body 216 may be exposed at a portion of a gauge height 228 of the gauge region 226 of the blade 218. For example, the body 216 may be exposed for an exposed height 230 of the gauge region 226 of the blade 218, where the exposed height 230 extends from a blade top 232 of the blades 218 to a transition between the gauge region 226 and the shoulder region 224, such as where the diameter of the bit 210 begins to decrease. The exposed height 230 may be the height of the exposure of the body 216 along the blades 218 from a blade top 232 of the blade 218 to a contact 234 between the matrix portion 212 and the body 216 at the blade 218.

The exposed height 230 is an exposure percentage of the gauge height 228. In some embodiments, the exposed height 230 may be 100% of the gauge height 228, or the steel portion 214 may be exposed along the entirety of the gauge region 226 of the blades 218. In some embodiments, the exposure percentage may be in a range having an upper value, a lower value, or upper and lower values including any of 10%, 20%, 30%, 40%, 50%, 60%, 70%, 80%, 90%, 95%, 98%, 99%, or any value therebetween. For example, the exposure percentage may be greater than 10%. In another example, the exposure percentage may be less than 99%. In yet other examples, the exposure percentage may be any value in a range between 10% and 99%. In some embodiments, it may be critical that the exposure percentage is greater than 50% to provide the benefit of toughness and ductility for the gauge region 226 of the bit 210. In some embodiments it may be critical that the exposure percentage is sufficient to allow the steel portion 214 to extend past the breaker slot 238 to allow the breaker slot to be formed primarily from the steel portion 214.

As discussed herein, the matrix portion 212 and the steel portion 214 may be formed from different materials. For example, the steel portion 214 may be formed from a material having a higher toughness and elasticity and the matrix portion 212 may be formed from a material that is more brittle and has a lower elasticity. Including the breaker slot 238 in the steel portion 214 may help to reduce damage to the bit 210 during the high torques applied when connecting the bit 210 to the drill string. The breaker slot 238 in the steel portion 214 may facilitate high torque connections to the drill string more reliably without cracking or failure than a breaker slot formed in a matrix portion.

Further, the matrix portion 212 may be formed from a material that has a higher erosion resistance than the steel portion 214. The cone region 220 and the nose region 222 may experience hydraulic conditions and formation interaction during drilling that are more erosive than at the gauge region 226. Locating the matrix portion 212 in the cone region 220, the nose region 222, and the shoulder region 224 may help to reduce erosion of the bit in those regions.

In accordance with at least one embodiment of the present disclosure, exposing the steel portion 214 at the gauge region 226 of a blade 218 may help to improve the operation of the bit 210. As may be understood, the gauge region 226 may extend to the full drilling diameter of the bit 210. The gauge region 226 may experience less wear and erosion than the cone region 220, the nose region 222, and the shoulder region 224 at least because of the fluid flow rate, number of cutting elements, and depth of cut. Because of the reduced wear and erosion at the gauge region 226, exposing the steel portion 214 at the gauge region 226 of a blades 218 may not significantly affect the life of the bit 210.

The matrix portion 212 may be exposed at the higher-wear regions of the bit 210, including the cone region 220, the nose region 222, and/or the shoulder region 224. This may help to protect the bit 210 from wear and/or erosion at these areas of increased wear and/or erosion.

The bit 210 includes a plurality of cutting elements 227 secured to the blades 218. The cutting elements 227 may be secured to the blades 218 in any region, including the cone region 220, the nose region 222, the shoulder region 224, and the gauge region 226. The cutting elements 227 may be secured to the blades 218 in any manner, such as by brazing the cutting elements 227 to the blades 218. The cutting elements 227 may be shaped and/or oriented to engage and degrade the formation. In some embodiments, the gauge region 226 may include one or more gauge elements 229. The gauge elements 229 may be embedded in the blades 218 at the gauge region 226 to help reduce wear of the blades 218 at the gauge region 226.

The bit 210 includes a bit connection 236. The bit connection 236 may be formed to secure the bit 210 to the BHA. For example, the bit connection 236 may form a threaded connection formed to mate with a complementary threaded connection at the BHA. In the embodiment shown, the bit connection 236 is a pin connection formed to mate with a complementary box connection. However, it should be understood that the bit connection 236 may include any other connection structure.

In accordance with at least one embodiment of the present disclosure, the bit connection 236 is integrally formed with the steel portion 214 of the bit 210. For example, the bit connection 236 and the steel portion 214 may be formed from the same massive block of material, without a joint, weld, fastener, or other joining structure connecting the steel portion 214 to the bit connection 236. As discussed herein, this may help to reduce the overall length of the bit 210, thereby increasing the DLS and/or drilling efficiency of the bit 210 and/or the bit 210 and steering system.

In the embodiment shown, the bit 210 includes a breaker slot 238. The breaker slot 238 may be a groove or indentation in the bit 210 into which a wrench or "breaker" may be inserted. The breaker may apply torque to the bit 210 to secure the bit 210 to the drill string and/or to remove the bit 210 from the drill string. The breaker slot 238 may be sized to receive the breaker such that the breaker may engage the bit 210. In some embodiments, the breaker slot 238 may be in from the steel portion 214. Forming the breaker slot 238 in the steel portion 214 may help to reduce and/or prevent damage to the bit 210 when tightening and/or loosening the bit 210 with the breaker slot 238.

Conventionally, the breaker slot 238 is formed in the connection portion of a bit, such as the welded portion of the bit between the steel blank and the bit connection. In accordance with at least one embodiment of the present disclosure, the breaker slot 238 may be formed in the gauge region 226 of the bit 210. In some embodiments, the breaker slot 238 may be formed in the gauge region 226 of the blades 218. For example, the blades 218 may, in the gauge region 226, be formed with the breaker slot 238 in them. As discussed herein, at least a portion of the blades 218, including at least a portion of the gauge region 226 of the blades 218, may be formed from the steel portion 214 (e.g., the steel portion 214 may be exposed in the gauge region 226 of the blades 218). In some embodiments, during manufacturing of the bit 210, the steel portion 214 may be formed with the breaker slot 238 formed therein. In some embodiments, the breaker slot 238 may be formed in the bit 210 after the bit 210 is formed. For example, the breaker slot 238 may be machined into the steel portion 214 after the matrix portion 212 is infiltrated.

FIG. 2-2 is a longitudinal cross-sectional view of the bit 210 of FIG. 2-1. As discussed herein, the bit 210 includes a matrix portion 212 and a steel portion 214. As may be seen, the matrix portion 212 may be at least partially embedded in the steel portion 214. For example, the steel portion 214 may form a connection opening 240. The connection opening 240 may be a hollow section in the steel portion 214. The matrix portion 212 may extend into the connection opening 240. In some embodiments, the matrix portion 212 may be secured to the steel portion 214 at the connection opening 240. For example, a connection portion 242 of the matrix portion 212 may be in contact with or secured to the connection opening 240 to secure the matrix portion 212 to the steel portion 214.

In some embodiments, the connection opening 240 may be formed in the body 216 of the bit 210. In some embodiments, the connection opening 240 may be formed in the body 216 of the bit 210 in the gauge region 226 of the bit 210. For example, the connection opening 240 (and the connection portion 242 inserted therein) may extend into the steel portion 214 adjacent to and/or in the gauge region 226 of the bit 210.

In some embodiments, the steel portion 214 may be located radially outward of the matrix portion 212 (e.g., the steel portion 214 may be located further away from a bit rotational axis 244 of the bit 210). For example, the steel portion 214 may be located radially outward of the matrix portion 212 in the gauge region 226 of the bit 210. In some examples, the steel portion 214 in the blades 218 of the bit 210 may be located radially outward of the matrix portion 212 of the bit 210 at the same longitudinal location. In some examples, the steel portion 214 in the body 216 of the bit 210 may be located radially outward of the matrix portion 212 of the bit 210 at the same longitudinal location.

During manufacturing of the bit 210, when the different portions of the bit 210 are located in the mold, including the steel portion 214, the matrix powder, and the infiltrant, each of these portions may be raised to the infiltration temperature to infiltrate the matrix powder to form the matrix portion 212. As may be understood, the matrix portion 212 and the steel portion 214 may have different coefficients of thermal expansion. As the infiltrated bit 210 cools, this may result in different portions of the bit 210 changing size at different rates. For example, the metals that form the steel portion 214 may likely have a higher coefficient of thermal expansion than the matrix material that form the matrix portion 212. Locating the steel portion 214 radially outward from the matrix portion 212 may cause the steel portion 214, as the bit 210 cools, to apply a compressive pressure to the matrix portion 212 at the connection portion 242. This may help to improve the connection between the matrix portion 212 and the steel portion 214 and/or reduce cracking and other stresses in the matrix portion 212 caused by thermal expansion mismatch.

The bit 210 may include a central bore 246. When the bit 210 is connected to the drill string (e.g., the RSS and/or the BHA), the central bore 246 may be in fluid communication with fluid path through the drill string. Fluid may pass through the central bore 246, into a fluid passage 248 in the body 216 and out of the bit 210. This fluid may cool the bit 210 (including cutting elements and/or the blades 218) and/or flush cuttings away from the bit 210.

In the embodiment shown, the matrix portion 212 may be located and/or exposed at the plenum 250 of the central bore 246. This may help to reduce and/or prevent erosion of the plenum or interior of the bit 210 at the plenum 250 of the central bore 246. For example, drilling fluid passing through the central bore 246 may impact the plenum 250 of the central bore 246 at a relatively high pressure. As discussed herein, the matrix portion 212 may be more erosion resistant than the steel portion 214, and exposing the matrix material of the matrix portion 212 at the plenum 250 of the central bore 246 may reduce the wear on the bit 210 at the plenum 250 of the central bore 246. This may help to expand the operating lifetime of the bit 210.

Figures 2, 3:
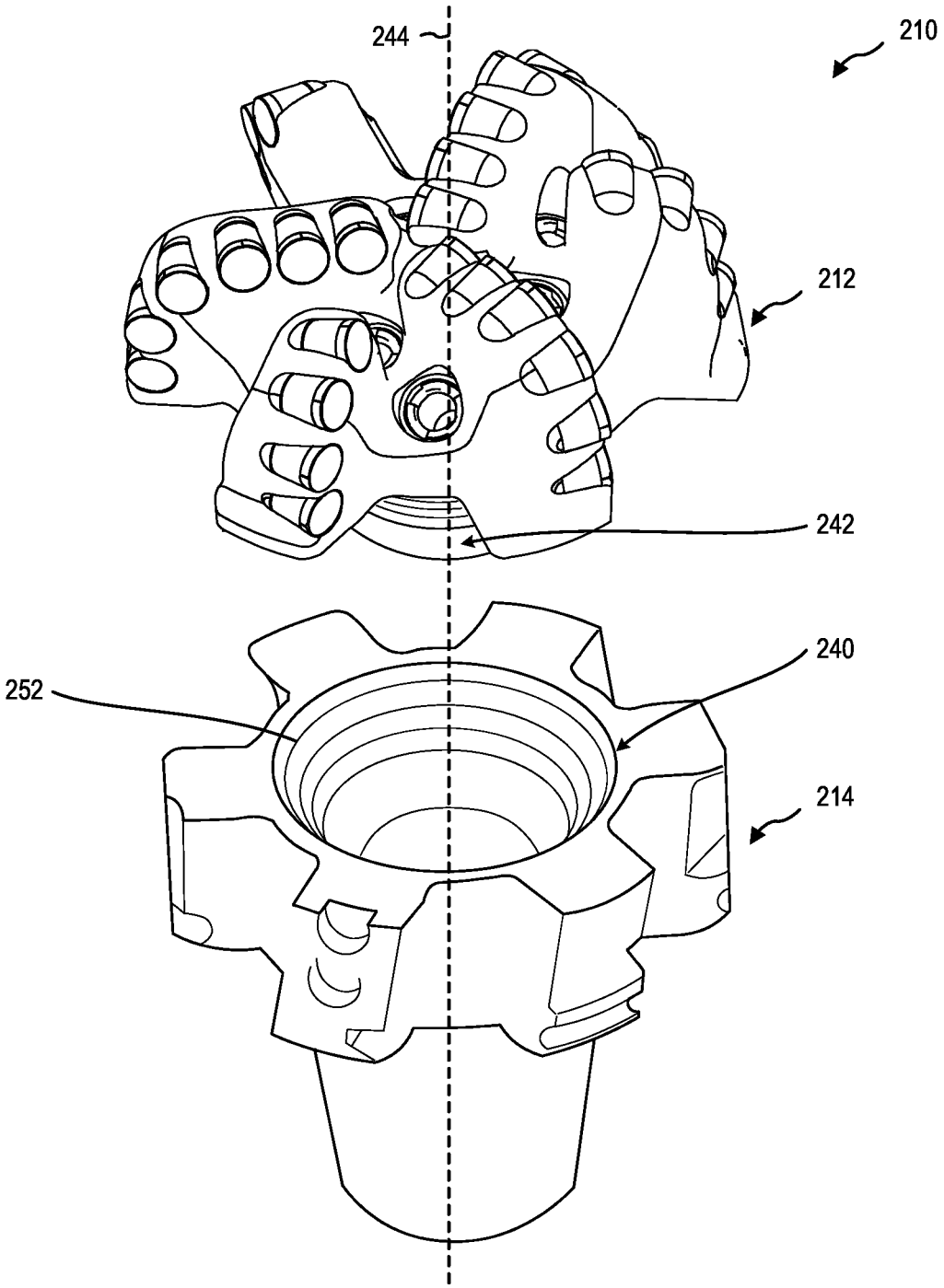
Figure 3:
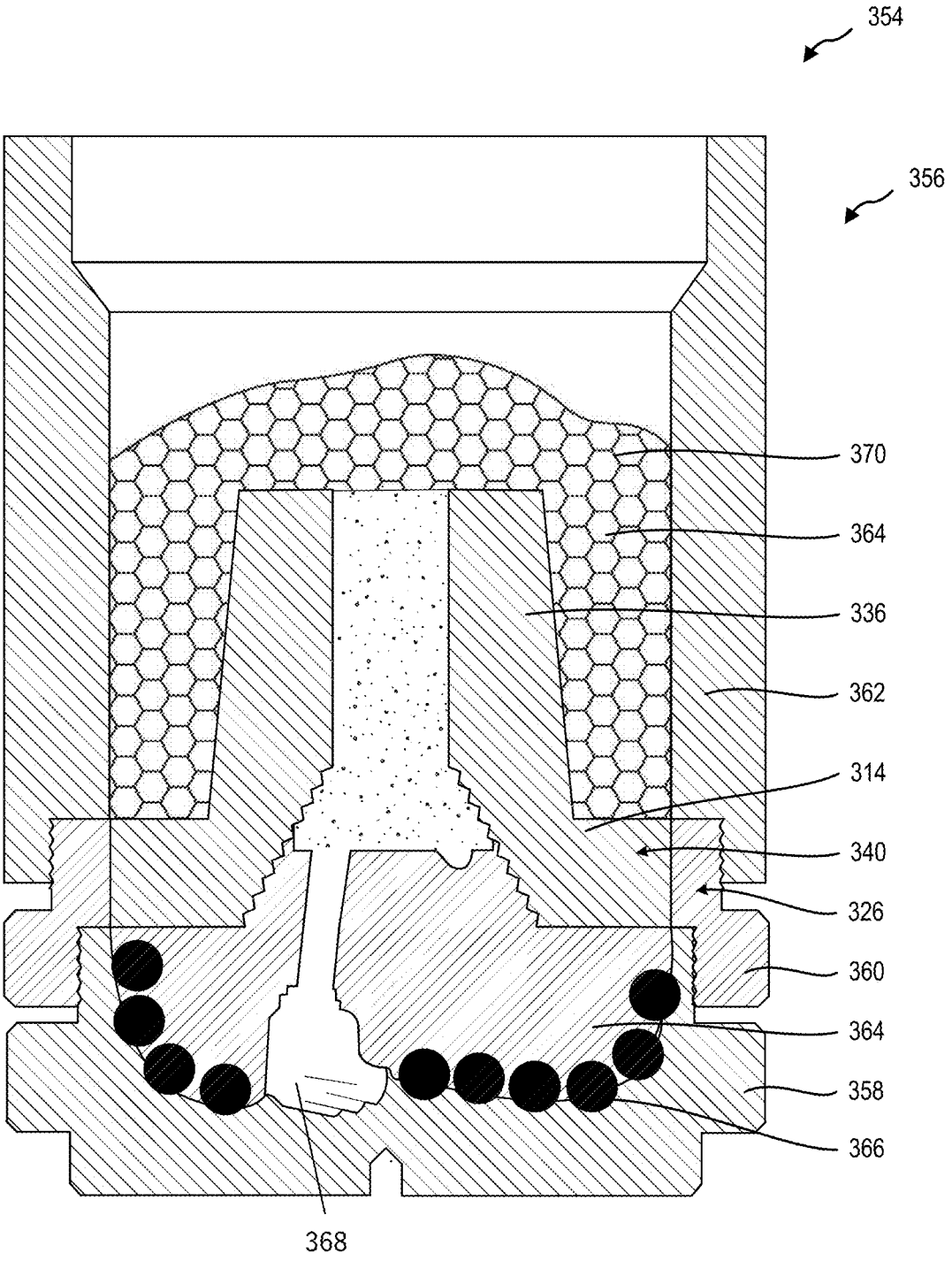

FIG. 2-3 is an exploded view of the bit 210 of FIG. 2-1. As discussed herein, the steel portion 214 includes a connection opening 240 in the body 216 of the bit 210. In some embodiments, the connection opening 240 may be generally conical or frustoconical. For example, the sides of the connection opening 240 may taper inwards toward the bit rotational axis 244. The matrix portion 212 may include a complementary connection portion 242. The connection portion 242 may extend into the connection opening 240 to secure the matrix portion 212 to the steel portion 214.

In the embodiment shown, the connection opening 240 includes a plurality of bonding structures 252. The connection structures 252 may help to improve the connection between the matrix portion 212 and the steel portion 214. For example, the bonding structures 252 may help to increase the surface area of the connection between the matrix portion 212 and the steel portion 214. Increasing the surface area of the connection between the matrix portion 212 and the steel portion 214 may help to increase the bonding area of the bond caused by infiltration of the matrix portion 212 with the infiltrant, thereby strengthening the connection. In some embodiments, the bonding structures 252 may help to form interlocking structures between the matrix portion 212 and the steel portion 214. An interlocking structure may be a structure that connects two elements in such a way that the two elements cannot be removed without plastic deformation and/or fracturing of the material(s). Interlocking structures may help to increase the strength of the connection between the matrix portion 212 and the steel portion 214.

In the embodiment shown, the bonding structures 252 include a plurality of radial ridges that extend around a perimeter of the connection opening 240. However, it should be understood that the bonding structures 252 may be in any shape or form, including domes, knobs, indentations, longitudinal ridges, any other shape or form, and combinations thereof.

In some embodiments, the matrix portion 212 and the steel portion 214 may be formed separately and later connected together. The matrix portion 212 may be secured to the steel portion 214 in any manner. For example, the matrix portion 212 may be secured to the matrix portion 212 with a braze, weld, mechanical fastener, any other connection mechanism, and combinations thereof.

FIG. 3 is a representation of a bit manufacturing system 354, according to at least one embodiment of the present disclosure. The bit manufacturing system 354 includes a bit mold 356. A bit may be formed in the bit mold 356. The bit mold 356 may include several sections, including a base section 358, a gauge section 360, and a funnel 362.

To form the bit, a steel section 314 may be inserted into the bit mold 356. As discussed above with respect to the steel portion 214 of FIG. 2-1 through FIG. 2-3, the steel section 314 may include a gauge region 326. The gauge region 326 may align with the gauge section 360 of the bit mold 356. For example, the steel section 314 may be secured to the bit mold 356 at the gauge section 360. The steel section 314 may include a bit connection 336 integrally formed with the gauge region 326 of the steel section 314. The bit connection 336 may extend into the funnel 362 of the bit mold 356.

Matrix powder 364 may be flowed into the base section 358. The base section 358 may form a negative impression of the bit, including a negative impression of the body, blades, junk slots, any other bit features, and combinations thereof. When the matrix powder 364 is infiltrated, it will solidify into the form of the bit or the approximate form of the bit based on the negative impression of the base section 358. In some embodiments, the resulting bit may be subject to processing after it is demolded.

The bit mold 356 may include one or more displacements around which the matrix powder 364 may be flowed to provide space for other bit structures. For example, the bit mold 356 may include one or more cutting element displacements 366. The cutting element displacements 366 may be inserted into the base section 358 to displace the matrix powder 364, thereby forming cutting element pockets for the cutting elements to be secured to the bit when the bit is formed. The bit mold 356 may further include a central crowfoot 368 that may displace out the area of the central bore and the downhole end, including one or more fluid passages that may direct fluid to nozzles or other structures out of the bit. In this manner, the matrix powder 364 may be flowed into the shape of the bit with minimal processing after the bit is fully formed.

As discussed herein, the steel section 314 may define a connection opening 340. The opening 340 may extend upward (e.g., away from the base section 358) and into the gauge region 326. When the matrix powder 364 is flowed into the base section 358, the matrix powder 364 may be flowed into the base section 358 until it fills the base section 358 and comes into contact with the steel section 314. The matrix powder 364 may further be flowed into the connection opening 340 and into contact with the steel section 314 at the connection opening 340.

The bit manufacturing system 354 may include an infiltrant 370. After the steel section 314 is secured to the bit mold 356 and the matrix powder 364 is flowed into the bit mold 356, the bit manufacturing system 354 may be heated to an infiltration temperature. The infiltration temperature may meet or exceed with a melting temperature of the infiltrant 370. When the infiltrant 370 melts, the infiltrant 370 may flow into the spaces between the grains of the matrix powder 364. In some embodiments, the steel section 314 may include one or more passages (e.g., central bore) therethrough that may allow passage of the infiltrant 370 through the steel section 314 and into the matrix powder 364.

When the infiltrant 370 has fully infiltrated the matrix powder 364 in the base section 358, the bit manufacturing system 354 may be cooled. Cooling the bit manufacturing system 354 may cause the infiltrant 370 to solidify, with the solidified infiltrant 370 binding the matrix powder 364 together in the form determined by the bit manufacturing system 354, including the negative impression of the base section 358 and any displacements. The bit mold 356 may be removed from the formed bit. In some embodiments, the portions of the bit mold 356 may be reused to manufacture additional bits.

Figure 4:
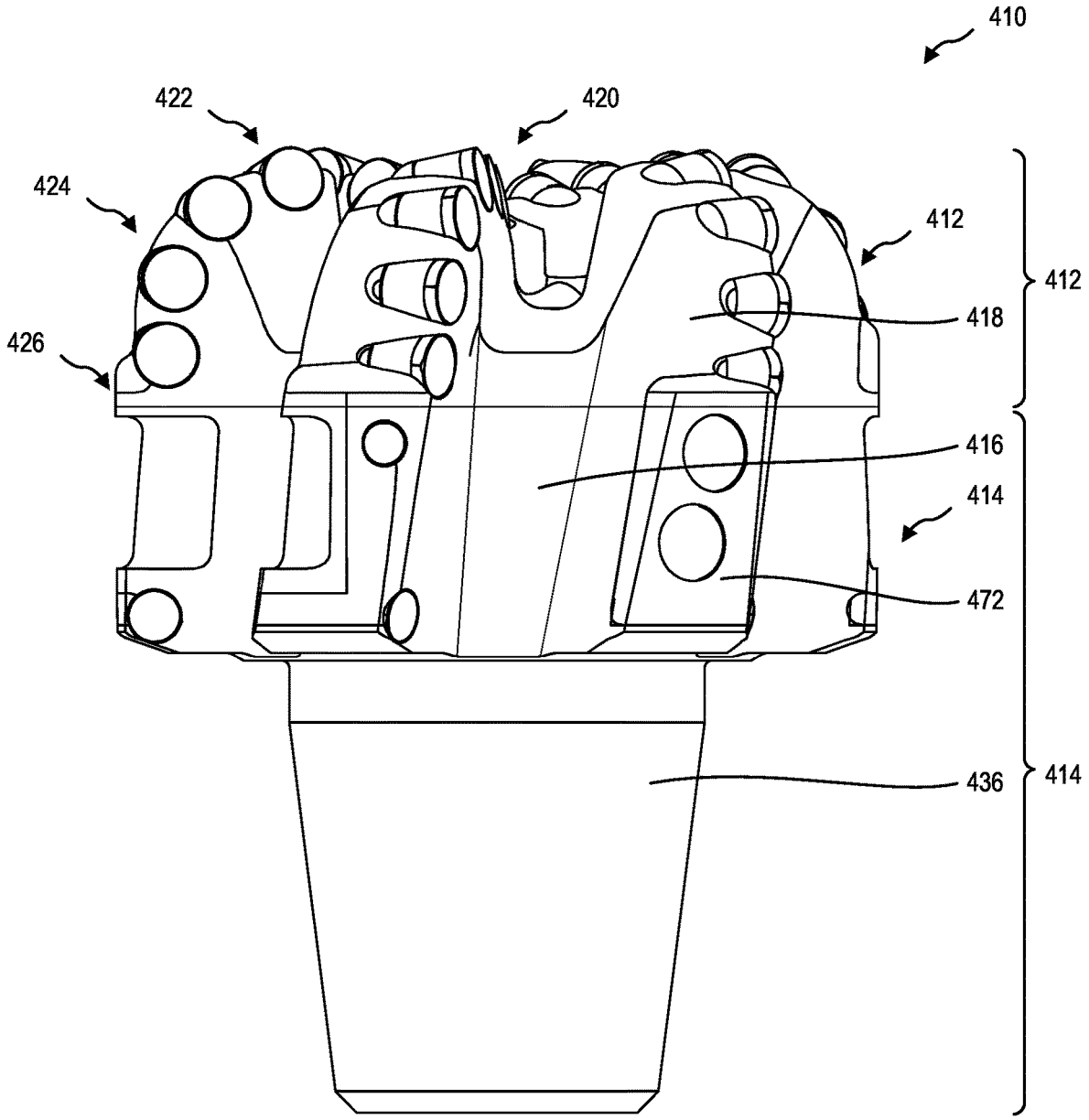
FIG. 4 is a representation of a bit having a matrix portion and a steel portion, according to at least one embodiment of the present disclosure.

FIG. 4 is a representation of a bit 410 having a matrix portion 412 and a steel portion 414, according to at least one embodiment of the present disclosure. The bit 410 includes a body 416 with a plurality of blades 418 extending therefrom. A bit connection 436 may be connected to the body 416 of the bit 410. For example, the bit connection 436 may be connected to and/or a part of the steel portion 414. In some embodiments, the bit connection 436 may be integrally formed with at least a portion of the body 416 at the steel portion 414. The bit 410 includes a cone region 420, a nose region 422, a shoulder region 424, and a gauge region 426. The steel portion 414 may be exposed in at least a portion of the gauge region 426 of the bit 410.

Conventionally, to protect exposed steel portions of a bit from wear and/or erosion during drilling operations, a bit may include hardfacing. Hardfacing may be a material that is applied to the outer surface of a bit to reduce wear. Typically, hardfacing is applied after the bit is manufactured (e.g., after infiltration of a matrix portion of the bit). However, hardfacing may be difficult and/or expensive to apply, including difficulties associated with cracking, flaking, and spalling. This may reduce the effectiveness of the hardfacing.

In accordance with at least one embodiment of the present disclosure, regions of the outer surface of the steel portion 414 may include a matrix surface 472. The matrix surface 472 may be a matrix material that is located on the outer surface of the blades 418 at the gauge region 426 to increase wear resistance and/or erosion resistance. The matrix surface 472 may be formed from an infiltrated matrix material that is infiltrated at the same time as the matrix portion 412. The infiltrated matrix material may be infiltrated while the matrix powder is in contact with the outer surface of the gauge region 426 of the blades 418, thereby causing the matrix surface 472 to be secured to the blades 418.

In some embodiments, the matrix surface 472 may be an extension of the matrix portion 412. For example, during formation of the bit 410 (as described above with respect to FIG. 3), matrix material may be flowed to the outer surface of the steel portion 414. During infiltration of the matrix portion 412, the infiltrant may flow into the matrix powder at the matrix surface 472. In some embodiments, the infiltrant may flow between the matrix surface 472 and the matrix portion 412. In this manner, the matrix surface 472 may be connected to the matrix portion 412. For example, the matrix surface 472 may be an extension of the matrix portion 412.

In some embodiments, the matrix surface 472 may be formed from a different matrix material than the matrix portion 412. For example, the matrix surface 472 may be formed from a matrix powder having a different material type, grain size, grain shape, grain distribution, and so forth. A different matrix material in the matrix surface 472 than the matrix portion 412 may allow for different properties at the gauge region 426 of the blades 418. For example, the matrix material in the matrix surface 472 may have a higher erosion/abrasion resistance than the matrix material of the matrix portion 412. In this manner, the matrix material for the matrix surface 472 and/or the matrix portion 412 may be tailored to the specific wear properties of the area. The matrix surface 472 may include hardfacing applied by welding, a plasma spray, adhesive, or heating process. In some embodiments, a hardfacing material (e.g., powder, welding rod, paste) may include the matrix powder.

Figure 5:
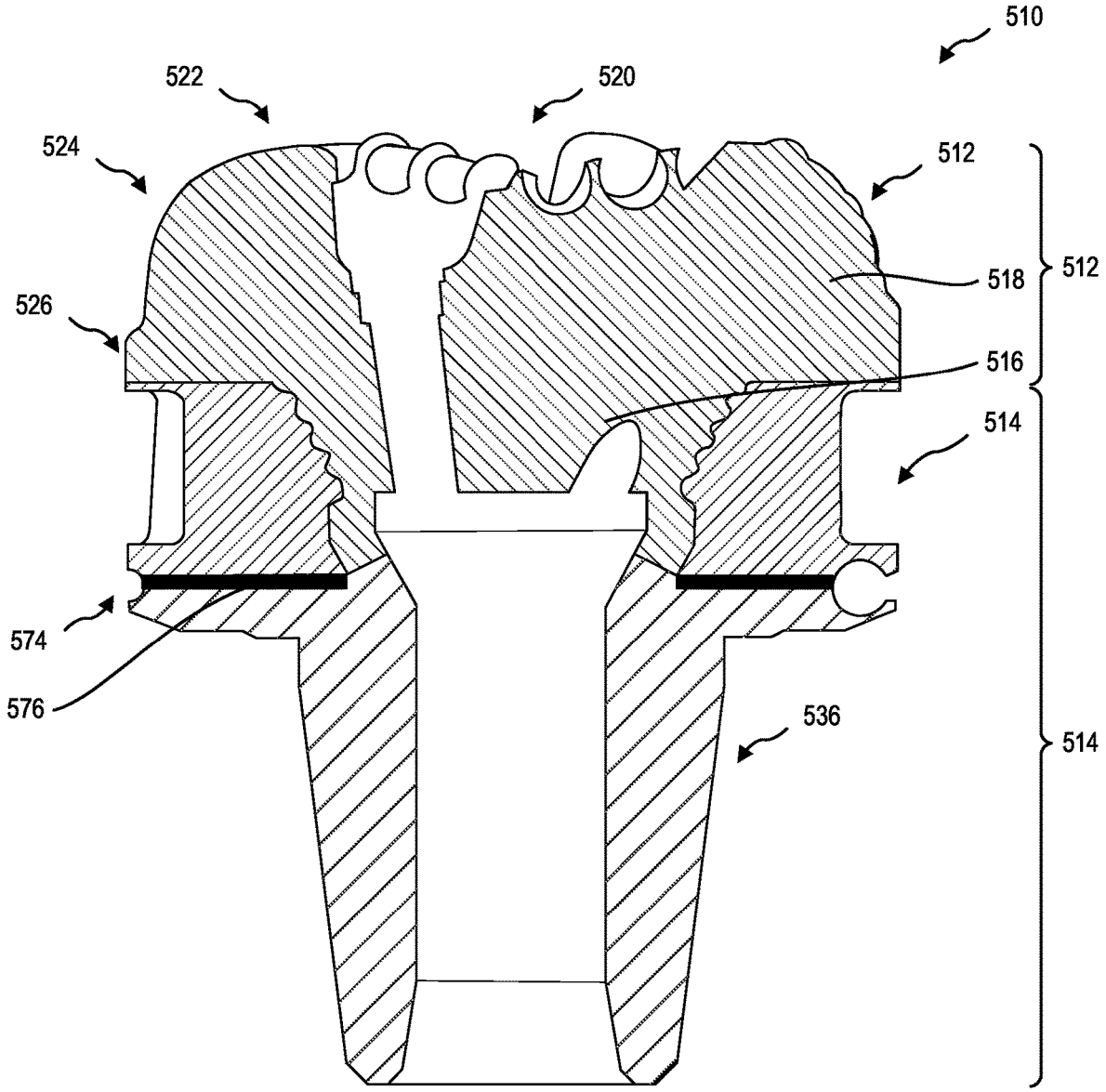
FIG. 5 is a representation of a bit having a matrix portion and a steel portion, according to at least one embodiment of the present disclosure.

FIG. 5 is a representation of a bit 510 having a matrix portion 512 and a steel portion 514, according to at least one embodiment of the present disclosure. The bit 510 includes a body 516 with a plurality of blades 518 extending therefrom. A bit connection 536 may be connected to the body 516 of the bit 510. For example, the bit connection 536 may be connected to the steel portion 514. The bit 510 includes a cone region 520, a nose region 522, a shoulder region 524, and a gauge region 526. The steel portion 514 may be exposed in at least a portion of the gauge region 526 of the bit 510.

In accordance with at least one embodiment of the present disclosure, the bit connection 536 may be welded to the steel portion 514. For example, the bit connection 536 may be welded to the steel portion 514 at an upper portion 574 of the bit 510. In some examples, the upper portion 574 may be located at the uphole end of the gauge region 526 of the bit 510. This may help to shorten the overall length of the bit 510.

As discussed herein, typically welding the bit connection 536 to the bit 510 adds significantly to the length of the bit 510. This is because conventional welding techniques include the use of a groove and an arc or resistance welder that utilize a long connection to generate the desired connection strength. In accordance with at least one embodiment of the present disclosure, the bit connection 536 may be welded to the steel portion 514 with electron beam welding to form an electron beam weld 576. Electron beam welding utilizes a high-energy beam of electrons to heat the materials of two adjacent structures to their melting points, causing the melted material to mix and fuse the two structures together.

Electron beam welds may be relatively small, thereby allowing for a reduced length of the bit 510. In some embodiments, the weld thickness of electron beam welds may be in a range having an upper value, a lower value, or upper and lower values including any of 1.0 mm, 5.0 mm, 10 mm, or any value therebetween. For example, the weld thickness may be greater than 1.0 mm. In another example, the weld thickness may be less than 10 mm. In yet other examples, the weld thickness may be any value in a range between 1.0 mm and 10 mm. In some embodiments, it may be critical that the weld thickness is less than 1 mm to reduce the length of the bit 510.

As discussed herein, joining the bit connection 536 to the steel portion 514 with the electron beam weld 576 may help to reduce the length of the bit 510. This may help to increase the DLS and/or improve drilling efficiency. In some embodiments, the bit connection 536 may be electron beam welded to the steel portion 514 after the matrix portion 512 is infiltrated. This may allow the bit connection 536 to maintain any heat treatment, thereby maintaining the bit 510 in compliance with any industry connection standards.

Figure 6:
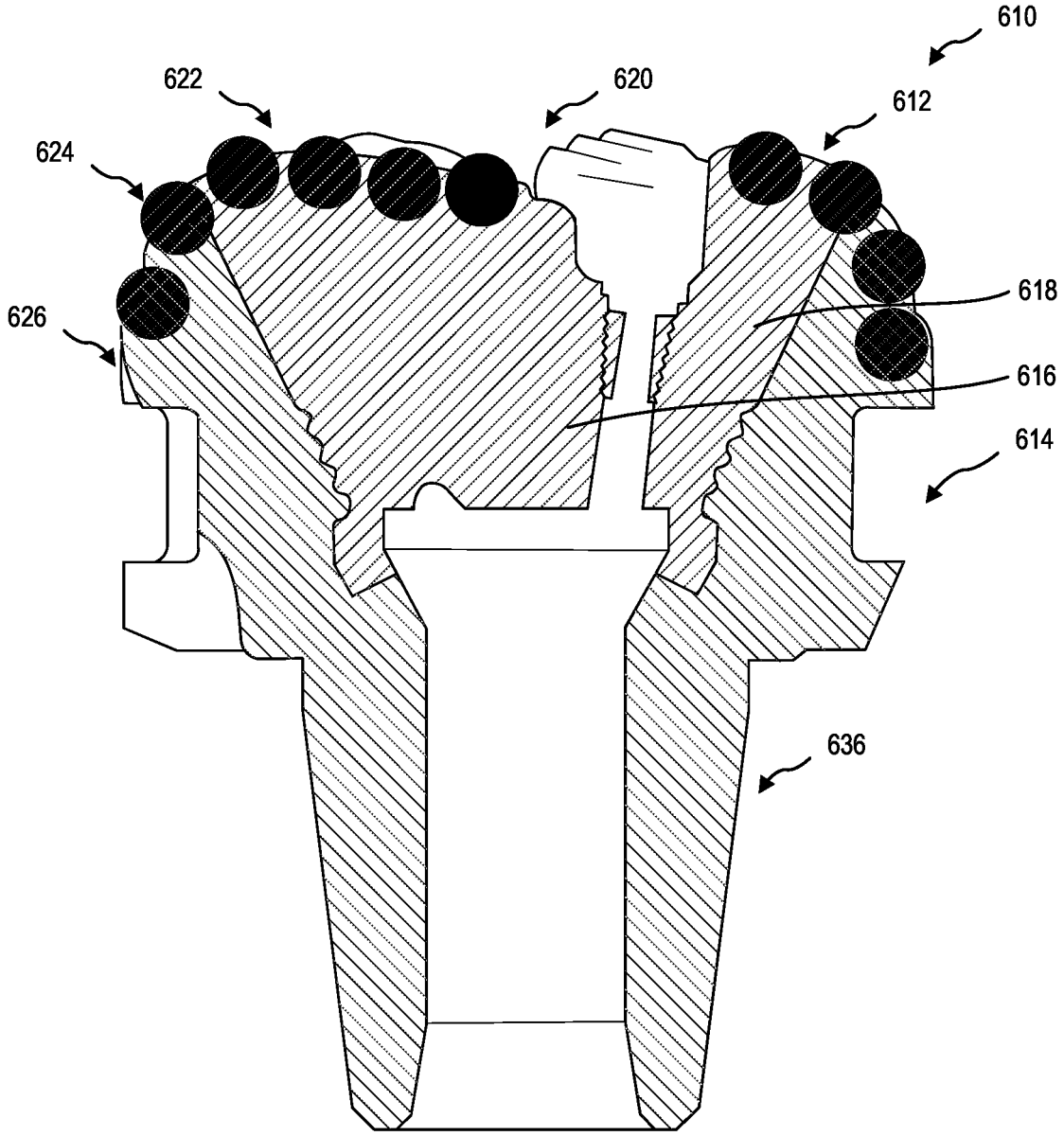
FIG. 6 is a representation of a bit having a matrix portion and a steel portion, according to at least one embodiment of the present disclosure.

FIG. 6 is a representation of a bit 610 having a matrix portion 612 and a steel portion 614, according to at least one embodiment of the present disclosure. The bit 610 includes a body 616 with a plurality of blades 618 extending therefrom. A bit connection 636 may be connected to the body 616 of the bit 610. For example, the bit connection 636 may be connected to and/or a part of the steel portion 614. In some embodiments, the bit connection 636 may be integrally formed with at least a portion of the body 616 at the steel portion 614. The bit 610 includes a cone region 620, a nose region 622, a shoulder region 624, and a gauge region 626.

As discussed herein, the steel portion 614 may be exposed in at least a portion of the gauge region 626 of the bit 610. In some embodiments, the steel portion 614 may extend into other regions of the bit 610. For example, in the embodiment shown, the steel portion 614 extends into the shoulder region 624 of the bit 610. The steel portion 614 may be exposed in the shoulder region 624. As discussed herein, the steel portion 614 may be located radially outward from the matrix portion 612 at the shoulder region 624. This may help to improve the ductility and/or toughness of the bit 610 in the regions in which the steel portion 614 is exposed, including the gauge region 626 and/or the shoulder region 624. In some embodiments, extending the steel portion 614 into the shoulder region 624 may help to increase the contact area between the matrix portion 612 and the steel portion 614, thereby increasing the connection strength between the matrix portion 612 and the steel portion 614.

Figure 7:
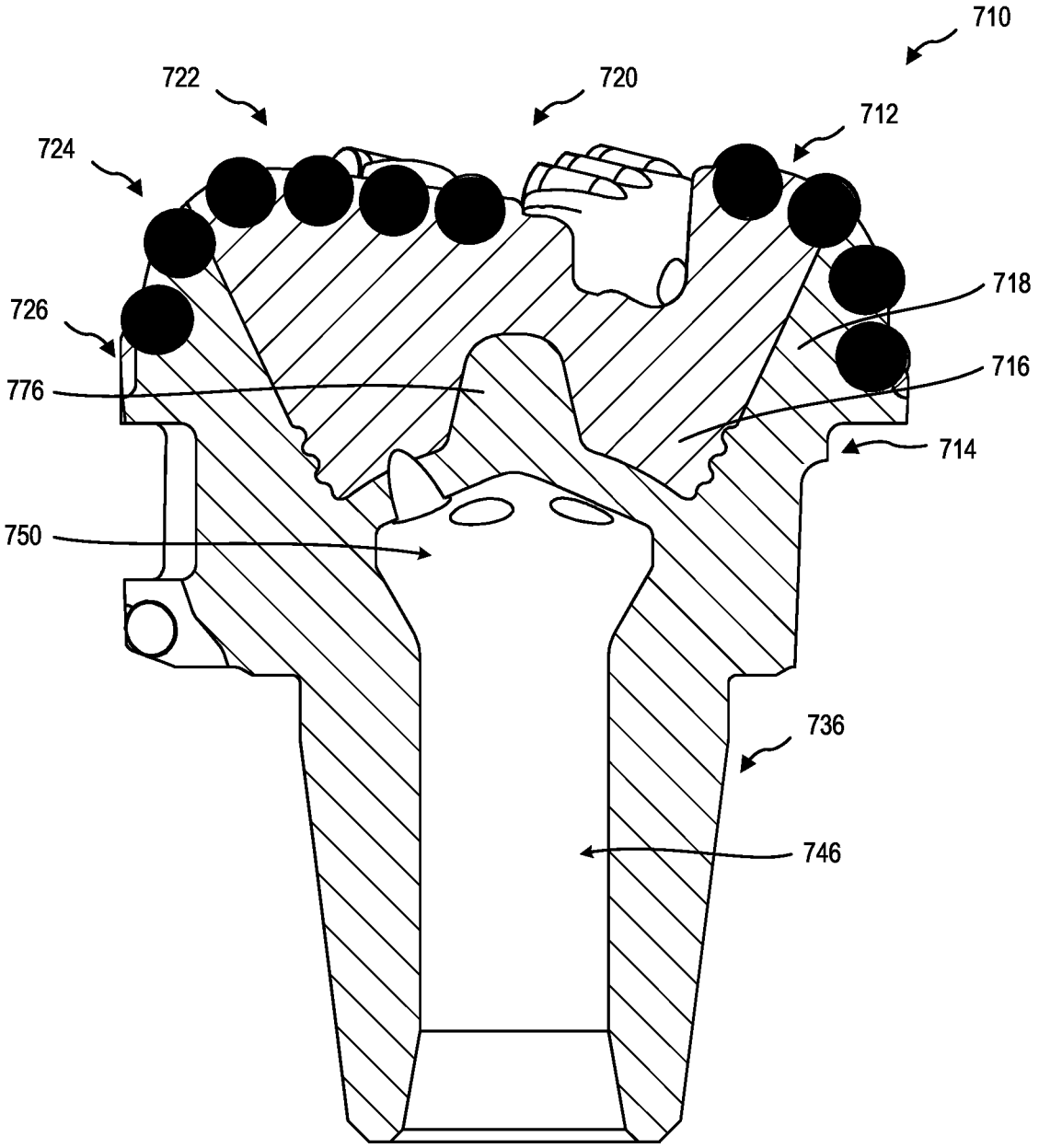
FIG. 7 is a representation of a bit having a matrix portion and a steel portion, according to at least one embodiment of the present disclosure.

FIG. 7 is a representation of a bit 710 having a matrix portion 712 and a steel portion 714, according to at least one embodiment of the present disclosure. The bit 710 includes a body 716 with a plurality of blades 718 extending therefrom. A bit connection 736 may be connected to the body 716 of the bit 710. For example, the bit connection 736 may be connected to and/or a part of the steel portion 714. In some embodiments, the bit connection 736 may be integrally formed with at least a portion of the body 716 at the steel portion 714. The bit 710 includes a cone region 720, a nose region 722, a shoulder region 724, and a gauge region 726.

In the embodiment shown, the steel portion 714 may include a protruding portion 776. The protruding portion 776 may extend into the body 716 of the bit 710. For example, the protruding portion 776 may extend into the matrix portion 712 in the body 716. This may help to increase the surface area of the contact between the matrix portion 712 and the steel portion 714, thereby increasing the strength of the connection between the matrix portion 712 and the steel portion 714. Further, and as discussed herein, the steel portion 714, located radially outward of the matrix portion 712, may apply a compressive force to the matrix portion 712. For example, the steel portion 714 may have a different coefficient of thermal expansion than the matrix portion 712. When the manufactured bit 710 is cooled, the steel portion 714 may reduce in size at a greater rate than the matrix portion 712, thereby causing the steel portion 714 to apply a compressive force to the matrix portion 712. This may help to increase the strength of the connection between the steel portion 714 and the matrix portion 712.

In the embodiment shown, the steel portion 714 may extend over a portion of a plenum 750 of a central bore 746 of the bit 710. The central bore 746 may extend through the bit connection 736 to provide fluid communication with the drill string, the RSS, and/or the BHA. This may place the steel portion 714 in contact with the drilling fluid as the drilling fluid passes through the central bore 746 prior to the drilling fluid being distributed through the nozzles to the outside of the bit 710.

Figure 8:
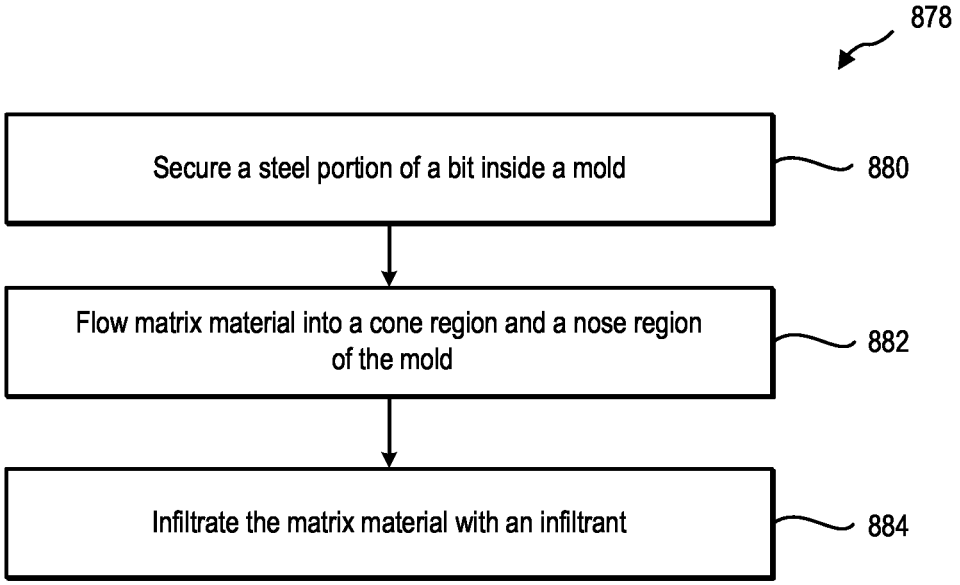
FIG. 8 is a flowchart of an example method for manufacturing a bit, according to at least one embodiment of the present disclosure.

FIG. 8 is a flowchart of an example method 878 for manufacturing a bit, according to at least one embodiment of the present disclosure. An operator may secure a steel portion of the bit inside a mold at 880. The steel portion may be located at a gauge region of the mold. The operator may flow matrix material into a cone region and a nose region of the mold at 882. At least a portion of the matrix material may be in contact with the steel portion. For example, at least a portion of the matrix material may be in contact with the steel portion outward of the matrix material. In some examples, the steel portion may be located radially outward of the matrix material. In some embodiments, flowing the matrix material may include flowing the matrix material such that at least a portion of the steel portion is exposed. For example, the matrix material may be flowed such that it does not contact the outer surface of the steel portion at the gauge region of the blades. This may help to expose the steel portion of the bit in a gauge region when the bit is completed.

In some embodiments, the bit may be manufactured in the order shown in FIG. 8, it should be understood that the acts of FIG. 8 may be performed in any order. For example, the steel portion may be inserted into the mold first, and the matrix powder flowed around the steel portion into the mold, followed by the infiltrant on top of the steel portion and/or the matrix powder. In some examples, the matrix powder may be flowed into the mold first, and the steel portion inserted into the mold after the matrix powder, followed by the infiltrant. In some examples, a first portion of the matrix material may be flowed into the mold, the steel portion may be inserted into the mold, and then a second portion of the matrix material may be flowed into the mold around the steel portion. The infiltrant may then be added to the mold after the second portion of the matrix material.

In some embodiments, the operator may infiltrate the matrix material with an infiltrant to form a matrix portion of the bit at 884. In some embodiments, infiltrating the matrix material may secure the matrix portion to the steel portion. For example, infiltrating the matrix material may include melting an infiltrant. The melted infiltrant may contact both the matrix material and the steel portion. When the infiltrant cools, the infiltrant may at least partially bond to the steel portion, thereby securing the matrix portion to the steel portion. Further, as discussed herein, when the steel portion cools, the steel portion may apply a compressive force to the matrix material, thereby further securing the steel portion to the matrix portion.

In some embodiments, after the matrix material is infiltrated, the operator may heat treat the steel portion. For example, the operator may apply heat to the steel portion in a pattern to adjust the properties of the steel portion and place the steel portion in compliance with industry standards. In some embodiments, the heat treatment may be applied to the entire steel portion. In some embodiments, the heat treatment may be applied to the bit connection of the steel portion. For example, the heat treatment may be selectively applied to the bit connection of the steel portion. The operator may selectively apply the heat treatment to the bit connection using any heat application mechanism, such as inductive heating, direct heat application, any other heat application mechanism, and combinations thereof. Selectively applying the heat treatment to the bit connection may reduce the heat cycling of the matrix portion of the bit, thereby reducing the chance of damage due to the heat cycling. In some embodiments, selectively applying the heat treatment may include selectively quenching portions of the bit. For example, a stream of quenching material (e.g., oil, water, salt water, air) may be applied to the bit (including the steel portion and/or the matrix portion downhole of the bit connection). This may further help to reduce heat cycling of materials not desired to be heat cycled. Applying the heat treatment to the bit connection may place the properties of the bit connection in compliance with industry standards.

In some embodiments, the bit may be formed with the bit connection fully formed, including any threaded connection or other connection mechanisms. In some embodiments, the bit connection may be processed after the bit is at least partially formed. For example, threads may be formed in the bit connection after the matrix portion has been infiltrated. This may help to improve the accuracy and/or precision of the thread placement and/or spacing. In some examples, threads may be formed in the bit connection before heat treating the steel portion. This may help to reduce the energy used to form the threads.

The embodiments of the bit have been primarily described with reference to wellbore drilling operations; the bits described herein may be used in applications other than the drilling of a wellbore. In other embodiments, bits according to the present disclosure may be used outside a wellbore or other downhole environment used for the exploration or production of natural resources. For instance, bits of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A bit for drilling an earth formation, comprising:

a matrix portion exposed at a cone region and a nose region of the bit;

a steel portion including a bit connection, the steel portion exposed at a gauge region and at least partially in a shoulder region of the bit; and a plurality of cutting elements secured to the matrix portion at the cone region and the nose region.

2. The bit of claim 1, wherein the steel portion includes a breaker slot at the gauge region.

3. The bit of claim 1, wherein at least a portion of the matrix portion is located radially inward from an outer surface of the steel portion at the gauge region.

4. The bit of claim 1, wherein the steel portion is not welded to the bit connection.

5. The bit of claim 1, wherein the steel portion is welded to the bit connection with an electron beam weld.

6. The bit of claim 1, further comprising a gauge element secured to the steel portion in the gauge region.

7. The bit of claim 1, further comprising:

a plurality of blades, each blade at least partially formed from the steel portion and the matrix portion; and a matrix surface secured to an outer surface of the gauge region of a blade of the plurality of blades.

8. The bit of claim 7, wherein the matrix surface is formed from a different matrix material than the matrix portion.

9. A bit for drilling an earth formation, comprising:

a body, the body including a steel portion and a matrix portion; and a plurality of blades extending from the body, each blade of the plurality of blades including a gauge region, at least one blade of the plurality of blades including a cone region, a nose region, and a shoulder region, wherein the steel portion extends from the body into each of the plurality of blades at the gauge region and at least partially into the shoulder region, the matrix portion extending from the body into the at least one of the plurality of blades at the cone region and the nose region, and wherein each of the plurality of blades has a plurality of cutting elements.

10. The bit of claim 9, wherein the steel portion is exposed along an entirety of the gauge region of the plurality of blades.

11. The bit of claim 9, wherein the steel portion extends from the body to a connection portion of the bit.

12. The bit of claim 11, wherein the steel portion is integrally formed between the body and the connection portion.

* * * * *